US008408453B2

(12) United States Patent
Mizushima

(10) Patent No.: US 8,408,453 B2
(45) Date of Patent: Apr. 2, 2013

(54) MONEY HANDLING MACHINE

(75) Inventor: Yoshikatsu Mizushima, Himeji (JP)

(73) Assignee: Glory Ltd., Himeji-shi (JP)

( * ) Notice: Subject to any disclaimer, the term of this patent is extended or adjusted under 35 U.S.C. 154(b) by 0 days.

(21) Appl. No.: 12/663,906

(22) PCT Filed: Jun. 11, 2007

(86) PCT No.: PCT/JP2007/061736
§ 371 (c)(1),
(2), (4) Date: Dec. 10, 2009

(87) PCT Pub. No.: WO2008/152685
PCT Pub. Date: Dec. 18, 2008

(65) Prior Publication Data

US 2010/0181333 A1 Jul. 22, 2010

(51) Int. Cl.
*G07F 19/00* (2006.01)

(52) U.S. Cl. ..... 235/379

(58) Field of Classification Search ..... 235/375, 235/379, 380, 381, 383; 700/231; 705/43
See application file for complete search history.

(56) References Cited

U.S. PATENT DOCUMENTS

| | | | | |
|---|---|---|---|---|
| 4,546,240 | A * | 10/1985 | Imamichi | 235/379 |
| 2004/0117061 | A1* | 6/2004 | Angove et al. | 700/236 |
| 2004/0134839 | A1* | 7/2004 | Kobayashi et al. | 209/534 |
| 2005/0263582 | A1* | 12/2005 | Yokoi et al. | 235/379 |

FOREIGN PATENT DOCUMENTS

| | | | |
|---|---|---|---|
| JP | 7-237784 | A | 9/1995 |
| JP | 2000-357257 | A | 12/2000 |
| JP | 2001-236548 | A | 8/2001 |
| JP | 2003-30717 | A | 1/2003 |
| JP | 2004-145600 | A | 5/2004 |
| JP | 2006-127131 | A | 5/2006 |

* cited by examiner

*Primary Examiner* — Kristy A Haupt
(74) *Attorney, Agent, or Firm* — Foley & Lardner LLP

(57) ABSTRACT

A money handling machine including a denomination-specific storing portion, money transport unit that transports money to a dispending portion and transport starting unit that causes the money transport unit to transport money stored in the denomination-specific storing portion. The money handling machine is instructed to dispense an amount of money, performs dispensing processing to bring the amount of money from the denomination-specific storing portion to the dispensing portion and performs dispensing limitation processing to prevent money determined not to be allowed to be dispensed from being dispensed. The dispensing processing includes starting the transport of the amount of money, and transporting money from the denomination-specific storing portion to the dispensing portion to replenish a shortage of money produced by the dispensing limitation processing. Thus, money that is not allowed to be dispensed is not dispensed, an accurate amount of money is dispensed and the dispensing processing occurs more quickly.

12 Claims, 8 Drawing Sheets

MONEY HANDLING MACHINE

TECHNICAL FIELD

The present invention relates to a money handling machine that performs processing such as for dispensing money such as banknotes.

BACKGROUND ART

In the window of a financial institution or the like, a money handling machine is used that is disclosed in, for example, patent document 1 and that performs depositing processing, dispensing processing and other types of processing. In the money handling machine, for example, when dispensing processing is performed, the amount of money corresponding to an instruction to dispense money is selected from money stored in a storing portion and is sequentially placed on a transport line. Such money is transported along the transport line to a predetermined dispensing outlet, with the result that the dispensing processing is achieved.

On the other hand, in the dispensing processing, in consideration of the possibility that money (for example, severely damaged money) which is unsuitable for being dispensed is stored in the storing portion, the money handling machine is designed such that such money is prevented from being erroneously dispensed. Specifically, a determination is made as to whether money that is being transported from the storing portion to the dispensing outlet is allowed to be dispensed, and the money that is determined not to be dispensed is subjected to, for example, processing (dispensing limitation processing) for transporting the money to a location other than the dispensing outlet.

When the dispensing limitation processing described above is performed, the amount of money that reaches the dispensing outlet is reduced by the amount of money that undergoes such processing, and thus, if the reduced amount of money is left without being treated, the amount of money dispensed is insufficient. For that reason, money is additionally transported so as to replenish such shortage, and thus the amount of money corresponding to the instruction to dispense money is successfully dispensed. When money of a plurality of denominations is dispensed, it is common to successively transport money of each denomination. Hence, in a case where, when the money of a certain denomination is being transported, a shortage occurs, money is additionally transported to replenish such shortage, and thereafter the transportation of the money of the succeeding denomination is started.

Patent document 1: JP-A-2004-145600

Patent document 2: JP-A-2003-30717

DISCLOSURE OF THE INVENTION

Problems to be Solved by the Invention

With the money handling machine described above, it is possible not only to prevent the money unsuitable for being dispensed from being dispensed but also to accurately dispense the amount of money corresponding to the instruction to dispense money. However, with the money handling machine, which does not start to transport, until a shortage in the money of a certain denomination is replenished, the money of the succeeding denomination, it is difficult to determine whether the transportation of the succeeding denomination is started until a determination is made as to whether a shortage is produced. Specifically, if a shortage is produced, it is necessary to additionally transport the money of the current denomination, whereas, if a shortage is not produced, it is possible to transport the money of the succeeding denomination; however, whether a shortage is produced is unclear until a determination is made as to whether the last dispensed money of the current denomination is allowed to be dispensed.

Hence, there has been a period of time (a blank period) during which no money is transported on the transport line, since the transportation of the last dispensed money of the current denomination is started until a determination is made as to whether it is allowed to be dispensed (during a period of time during which the last dispensed money is transported from a transport start position to a position where the determination processing is performed). Consequently, as compared with a case where there is no blank period, the dispensing processing delays and takes longer. This can cause a serious problem under current conditions where a rapid dispensing transaction is required.

In view of the above problem, the present invention has an object to provide a money handling machine with which it is possible not only to prevent money unsuitable for being dispensed from being dispensed but also to accurately dispense the amount of money corresponding to an instruction to dispense money, and with which it is also possible to rapidly perform dispensing processing.

Means for Solving the Problem

To achieve the above object, according to the present invention, there is provided a money handling machine for handling money that includes: a denomination-specific storing portion that has a plurality of storing units and that stores money by denomination in the storing units; a money transport unit that transports money to a predetermined dispensing portion; a transport starting unit that causes the money transport unit to start transport of the money stored in the denomination-specific storing portion; and a dispensing limitation portion that performs dispensing limitation processing on the money being transported, in which at least dispensing processing is performed in which, an amount of money to be dispensed out of the money stored in the denomination-specific storing portion is brought to the dispensing portion through the transport; the dispensing limitation processing is processing in which whether or not the money is allowed to be dispensed is determined based on predetermined conditions, and in which the transport of money determined not to be allowed to be dispensed is prevented from being completed such that the money is not dispensed; and the dispensing processing includes a first step of causing the transport starting unit to start the transport of the amount of money to be dispensed and a second step of transporting, after completion of the first step, money from the denomination-specific storing portion to the dispensing portion such that a shortage of dispensed money produced by performing the dispensing limitation processing is replenished (first configuration).

With this configuration, it is possible to transport the money to the dispensing portion through the transport of the money by the money transport unit. Since the dispensing limitation portion is provided, it is possible to prevent the money that is not allowed to be dispensed from being dispensed.

In the dispensing processing, since the processing in the first and second steps is performed, it is possible to quickly perform the processing as compared with dispensing processing in which a shortage of dispensed money is checked each time money of a given denomination is dispensed, and in which the money of the denomination is continuously dispensed (the process does not proceed to the dispensing of another denomination) until the shortage is replenished.

According to the present invention, there is provided a money handling machine for handling money that includes: a money handling machine for handling money comprising: a denomination-specific storing portion that has a plurality of storing units and that stores money by denomination in the storing units; a money transport unit that transports money to a predetermined dispensing portion; a transport starting unit that causes the money transport unit to start transport of the money stored in the denomination-specific storing portion; and a dispensing limitation portion that performs dispensing limitation processing on the money being transported, in which at least dispensing processing is performed in which, an amount of money to be dispensed out of the money stored in the denomination-specific storing portion is brought to the dispensing portion through the transport; the dispensing limitation processing is processing in which whether or not the money is allowed to be dispensed is determined based on predetermined conditions, and in which the transport of money determined not to be allowed to be dispensed is prevented from being completed such that the money is not dispensed; and the dispensing processing is processing in which, after the transport of the amount of money to be dispensed is all started, money is transported from the denomination-specific storing portion to the dispensing portion such that a shortage of dispensed money produced by performing the dispensing limitation processing is replenished (second configuration).

With this configuration, it is possible to transport the money to the dispensing portion through the transport of the money by the money transport unit. Since the dispensing limitation portion is provided, it is possible to prevent the money that is not allowed to be dispensed from being dispensed.

In the dispensing processing, since, until the transport of the amount of all money corresponding to an instruction to dispense money is started, a shortage of dispensed money is not replenished, it is possible to quickly perform the processing as compared with dispensing processing in which a shortage of dispensed money is checked each time money of a given denomination is dispensed, and in which the money of the denomination is continuously dispensed (the process does not proceed to the dispensing of another denomination) until the shortage is replenished.

In the first or the second configuration, the money transport unit may include a transport line that produces a flow for transferring the money to the dispensing portion, and the transport starting unit may start the transport by putting the money on the flow of the transport line (the third configuration).

With this configuration, simply by preparing a transport line (for example, belt conveyer type) for producing a predetermined flow and putting money on the flow of this transport line, it is possible to achieve the transport of money. Thus, it is possible to effectively achieve the transport.

In the first configuration, the money handling machine may be configured in which, when the dispensing processing is performed on money of a plurality of denominations, any of first processing and second processing can be selected and performed as the dispensing processing, and the first processing includes: the first step; and the second step, whereas the second processing includes: a third step of transporting, with the money transport unit, money of a given denomination out of the amount of money to be dispensed; a fourth step of transporting, when a shortage of dispensed money of the denomination is produced by performing the dispensing limitation processing, the money of the denomination until the shortage is replenished; and a fifth step of performing the third step and the fourth step on money of each of the plurality of denominations in a sequential manner (the fourth embodiment).

With this configuration, since any of the first processing and the second processing can be selected and performed, it is easier to perform dispensing processing that is more suitable for the situation.

In the fourth configuration, the money handling machine may be configured in which a user can select which one of the first processing and the second processing is performed (the fifth configuration). With this configuration, it is possible to achieve dispensing processing corresponding to the decision of the user.

In the fourth configuration, the money handling machine may be configured in which a communication interface which enables communication with an external device is provided, and in which one of the first processing and the second processing is selected is determined based on information transmitted from the external device (the sixth embodiment).

With this configuration, it is possible to select any of the first processing and the second processing by the use of an external device such as a communication terminal. Thus, it is possible for a teller or the like to easily control dispensing processing.

In the first or the second configuration, the money transport unit may be configured in which the dispensing portion has a mechanism of collecting the money transported from the denomination-specific storing portion on a denomination-by-denomination basis (the seventh configuration).

With this configuration, it is possible to collect dispensed money on a denomination-by-denomination basis; this makes it possible for a teller or the like to eliminate an operation for dividing the dispensed money on a denomination-by-denomination basis. Thus, it is possible to reduce work and time on a depositing transaction.

In the third configuration, the money transport unit may be configured in which the transport starting unit transfers the money stored in the denomination-specific storing portion to a transport start position, on the transport line, that is predetermined for each of the storing units so as to put the money on the flow of the transport line; and, when money of a plurality of denominations is transported to the dispensing portion, the dispensing processing starts the transport from money stored in one of the storing units where a distance on the transport line between the dispensing portion and the transport start position is greatest, in decreasing order of the distance (the eighth embodiment).

With this configuration, when money is transported on the transport line, it is easier to start, soon after the transport of the last money of the preceding denomination, the transport of money of the succeeding denomination. Thus, the blank period of the transport is minimized, and this makes it easier to reduce the dispensing processing time.

The following method (the ninth method) is also useful: a method of controlling a money handling machine including a denomination-specific storing portion that has a plurality of storing units and that stores money by denomination in the storing portions such that the money handling machine performs dispensing processing in which an amount of money to be dispensed out of the money stored in the denomination-specific storing portion is transported to a predetermined dispensing portion, the method including: a sixth step of starting the transport of the amount of all money to be dispensed out of the money stored in the denomination-specific storing portion to the dispensing portion; a seventh step of determining, on the money being transported in the sixth step, whether or not the money is allowed to be dispensed, and of performing, on money determined not to be allowed to be dispensed, the dispensing limitation processing for preventing the transport from being completed; and an eighth step of transporting, after completion of the sixth step, money from the denomination-specific storing portion to the dispensing portion such that a shortage of dispensed money produced by performing the dispensing limitation processing is replenished.

Advantages of The Invention

With a money handling machine according to the present invention, it is possible to transport money to a dispensing portion through the transport of the money by money transport unit. Since it is provided with a dispensing limitation portion, it is possible to prevent money that is not allowed to be dispensed from being dispensed.

In the dispensing process, the processing (or a shortage of dispensed money is not replenished until the transport of the amount of all money corresponding to an instruction to dispense money is started) in the first and second steps is performed. Thus, it is possible to quickly perform the processing as compared with dispensing processing in which a shortage of dispensed money is checked each time money of a given denomination is dispensed, and in which the money of the denomination is continuously dispensed (the process does not proceed to the dispensing of another denomination) until the shortage is replenished.

LIST OF REFERENCE SYMBOLS

Figure 1:
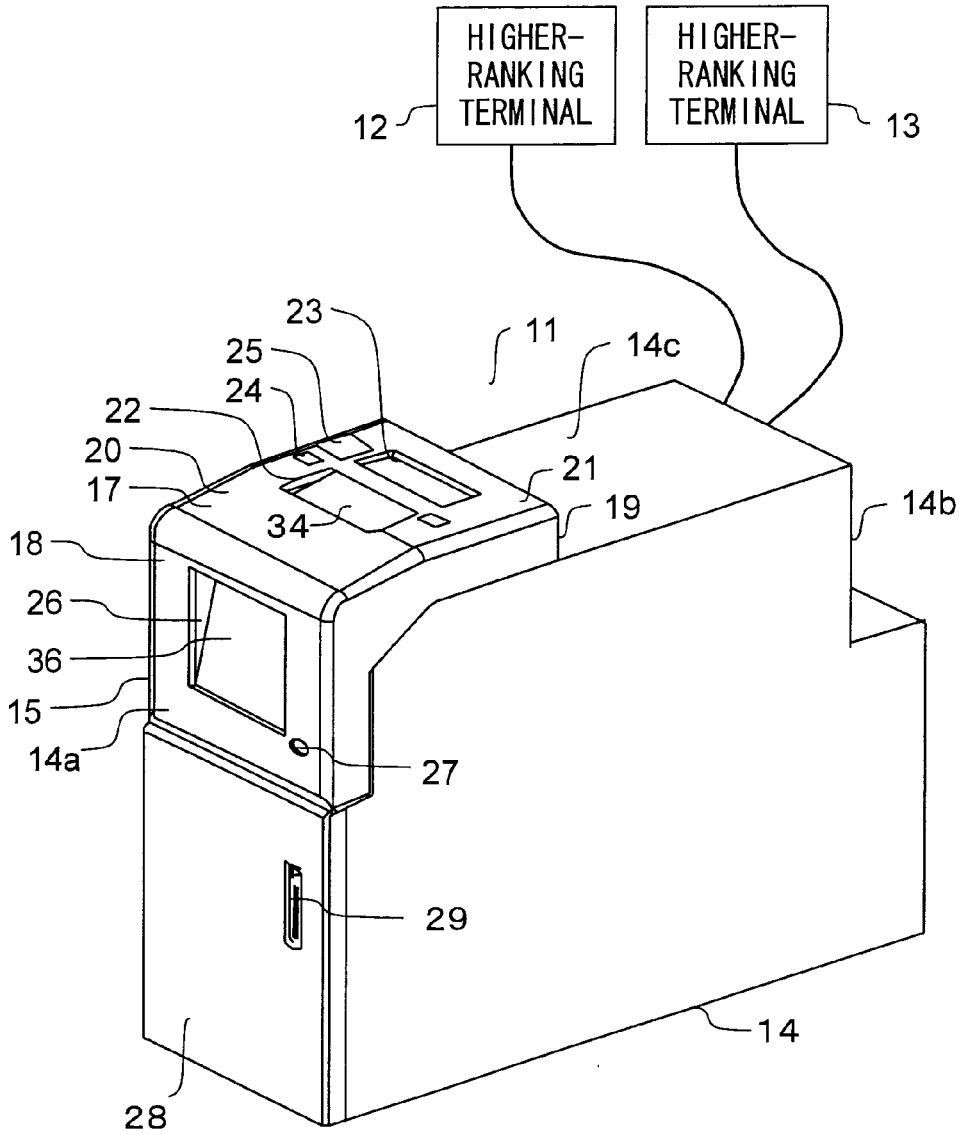
[FIG. 1] An appearance diagram of a circulation type banknote depositing and dispensing machine according to an embodiment of the present invention.

11 Circulation type banknote depositing and dispensing machine (money handling machine)
12 & 13 Higher-ranking terminals (external devices)
22 Banknote dispensing outlet
23 Banknote depositing inlet
32 Banknote dispensing portion
24 Occupation button
34 Transparent shutter
35 Deposited banknote temporarily holding portion
36 Front door
40 Upper unit banknote transport portion
50 Banknote recognition portion
82 Reject box
83 Denomination-specific banknote storing portions
85 Lower unit banknote transport portion
201 Transport line
203 Storage portion
204 Control portion
210 Movable banknote storage unit

BEST MODE FOR CARRYING OUT THE INVENTION

Example 1

An embodiment of the present invention will be described below with reference to the accompanying drawings. The configuration of a circulation type banknote depositing and dispensing machine (hereinafter referred to as a "banknote depositing and dispensing machine") according to this embodiment will be first described.

In FIG. 1, an appearance diagram of the circulation type banknote depositing and dispensing machine (hereinafter simply referred to as the "banknote depositing and dispensing machine") 11 is shown; in FIG. 2, a cross-sectional view of the banknote depositing and dispensing machine 11 is shown. This banknote depositing and dispensing machine 11 is installed in the counter of a financial institution such as a bank, and specifically is installed between two tellers behind the counter; the depositing and dispensing machine 11 can be used by either or both of the tellers on the left and right of the banknote depositing and dispensing machine 11.

The banknote depositing and dispensing machine 11 is provided with a communication interface; higher-ranking terminals 12 and 13 operated by the two tellers on the left and right are connected to the communication interface. Thus, the higher-ranking terminals 12 and 13 and the banknote depositing and dispensing machine 11 can bi-directionally communicate with each other. There are three ways of using the banknote depositing and dispensing machine 11: only one of the higher-ranking terminals 12 and 13 uses the banknote depositing and dispensing machine 11; and both of them use the banknote depositing and dispensing machine 11.

The banknote depositing and dispensing machine 11 has a main body 14; the main body 14 is configured such that, when an operation surface operated by the tellers is assumed to be a front surface 14*a* and the opposite surface of the front surface 14*a*, that is, the surface facing a customer in front of the counter is assumed to be a rear surface 14*b*, the main body 14 is uprightly mounted with a narrow width in a lateral direction, a wide depth in a forward and backward direction and a long height in a vertical direction.

The main body 14 is provided with an upper unit 15 and a lower unit 16 so that they can be removable from the side of the front surface of the main body 14.

On the front side of the upper surface of and the upper side of the front surface of the upper unit 15, there are arranged an upper surface operation portion 17 and a front surface operation portion 18, respectively, as an operation portion. The upper surface operation portion 17 protrudes upward from the upper surface 14*c* of the main body 14. A fitting step portion 19 to which a counter fits is formed on an upper surface region of the main body 14 behind the upper surface operation portion 17, the counter having a width dimension equal to a distance from the fitting step portion 19 to the rear surface 14*b* of the main body 14 is fitted to the upper surface 14*c* of the main body 14 and the upper surface of the upper surface operation portion 17 is so arranged as to be substantially equal in height to that of the counter.

In the upper surface operation portion 17 of the upper unit 15, that is, in the front side of the upper surface of the main body 14, a slant surface 20 that extends forward and slants downward and a substantially horizontal surface 21 are formed in this order from the front side. In the horizontal surface 21, a banknote dispensing outlet 22 through which banknotes are dispensed and a banknote depositing inlet 23 through which banknotes are deposited are formed in this order from the front side. On the left and right sides of the banknote dispensing outlet 22 and the banknote depositing inlet 23, there are arranged occupation buttons 24 that serve as an occupation indication portion for indicating which one of the tellers on the left and right occupies the depositing processing or the dispensing processing. On one side of the banknote dispensing outlet 22 and the banknote depositing inlet 23, that is, on the left side thereof, there is arranged a display portion 25 that displays a location where a banknote jam occurs and the number of remaining banknotes. The occupation buttons 24 each incorporate a lamp, and the lamp lights when the banknote depositing and dispensing machine 11 is occupied by being operated.

In the front surface operation portion 18 of the upper unit 15, there is formed an opening portion 26 through which banknotes returned due to the non-approval of a depositing operation after deposited banknotes are escrowed at the time of the depositing processing are taken out; the opening portion 26 is blocked by a front door 36. An upper unit lock 27 is provided that is operated by a teller and that is opened and closed with the upper unit 15 housed in the main body 14. The upper unit lock 27 is opened, and thus the upper unit 15 can be removed from the main body 14.

In a lower portion of the front surface of the main body 14, a door member 28 is fitted such that it can be opened and closed. In the door member 28, a lower unit lock 29 is provided that is opened and closed with the lower unit 16 housed in the main body 14 and the door member 28 closed and that can only be operated by a senior manager of a financial institution or a staff member of a security company; the lock of the door member 28 is opened and thus the door member 28 is opened, with the result that it is possible to remove the lower unit 16 out of the main body 14 in a frontward direction. The lower unit lock 29 cannot be opened by a teller.

Below the banknote dispensing outlet 22 and the banknote depositing inlet 23 of the upper unit 15, there are arranged a box-shaped banknote dispensing portion 32 and a box-shaped banknote depositing portion 33, respectively that house a banknote in an upright position with the short edge direction of the rectangular banknote coinciding with a vertical direction. In the banknote dispensing outlet 22, a transparent shutter 34 is arranged such that it can be opened and closed; the transparent shutter 34 closes the banknote dispensing outlet 22 while money is dispensed and opens it at the time of the completion of the dispensing of money; and it is possible to see, through the transparent shutter 34 closed while money is dispensed, banknotes that are being dispensed into the banknote dispensing portion 32.

Inside the opening portion 26 of the front surface of the upper unit 15, that is, in a front side region of the main body 14, there is arranged a deposited banknote escrow portion 35 that receives deposited banknotes determined to be authentic, that is, deposited authentic banknotes and that collectively escrows the banknotes of different denominations. In the front surface of the deposited banknote escrow portion 35, the transparent front door 36 that is locked by an unillustrated electromagnetic lock with the front door 36 closed is arranged such that it can be opened and closed; since, when the escrowed banknotes are returned, the electromagnetic lock is opened, it is possible to collectively receive, by holding a knob 37 provided in the front door 36 and opening the front door 36 forward from the opening portion 26, the escrowed banknotes at the time of the non-approval of the depositing operation stored in the deposited banknote escrow portion 35 through the opening portion 26.

In the upper unit 15, there is provided an upper unit banknote transport portion 40 that is connected to the banknote dispensing portion 32, the banknote depositing portion 33 and the deposited banknote escrow portion 35 and that transports banknotes. The upper unit banknote transport portion 40 is provided with: a dispensing transport path portion 41 that transport a banknote to the banknote dispensing portion 32; a depositing transport path portion 42 that transports a banknote fed from the banknote depositing portion 33; an escrow transport path portion 43 that is connected to a halfway portion of the dispensing transport path portion 41 and that transports a banknote between the escrow transport path portion 43 and the deposited banknote escrow portion 35; a recognition transport path portion 44 that is folded back from the back to the front into an approximate U-shape and whose one end on the upper side is connected to the banknote transport portion 42; a bypass transport path portion 45 that connects the one end on the upper side of the recognition transport path portion 44 to the other end on the lower side; an escrow dispensing transport path portion 46 that is connected between the dispensing transport path portion 41 and the one end (the upper end of the bypass transport path portion 45) on the upper side of the recognition transport path portion 44; a rejected banknote transport path portion 47 that is connected to the escrow dispensing transport path portion 46 and that extends forward; a storing/dispensing transport path portion 48 that is connected to the other end (the lower end of the bypass transport path portion 45) on the lower side of the recognition transport path portion 44, that extends forward and whose front end is connected to the rejected banknote transport path portion 47.

At least the dispensing transport path portion 41, the escrow transport path portion 43, the recognition transport path portion 44, the escrow dispensing transport path portion 46 and the storing/dispensing transport path portion 48 can reverse the banknote transport direction, that is, can perform the transport in both forward and reverse directions. At the portions connected between the transport path portions 41 to 48, there are provided switching members 49 that switch a direction in which a banknote moves. On the recognition transport path portion 44, there is provided a banknote recognition portion 50 that recognizes the denomination, the authenticity, the fitness and the like of a banknote that is transported. The "denomination" refers to the type of money, the "authenticity" refers to whether or not money is counterfeit (whether it is authentic or counterfeit) and the "fitness" refers to whether or not money meets predetermined criteria (for example, criteria for the degrees of soil and damage) to be appropriate.

The banknote dispensing portion 32 is provided with: a blade roller 53 that feeds banknotes transported through the dispensing transport path portion 41 into the banknote dispensing portion 32 in an upright position on a one-by-one basis; and a tray 54 that receives, in an upright position, the banknotes fed by the blade roller 53 and that moves according to the number of banknotes received so that the position at which the banknotes are received is stationary and that the banknotes are kept in an upright position and placed in proper alignment in a front area.

The banknote depositing portion 33 is provided with: a tray 57 that receives deposited banknotes in an upright position; a kick roller 58 that feeds downward on a one-by-one basis banknotes that are placed in an upright position and in proper alignment by being pushed by the tray 57 which moves at the start of the depositing processing; and a feed roller 59 and a gate roller 60 that hold the banknotes fed by the kick roller 58 to feed them to the depositing transport path portion 42.

In the deposited banknote escrow portion 35, the escrow transport path portion 43 is connected to the upper side of the rear surface thereof, the upper side of the rear surface slants backward and downward and the banknotes are placed, with the sides of the banknotes pointing in a vertical direction, on a collection board 65 that moves up and down within the deposited banknote escrow portion 35 between a front wall 63 serving as the front door 36 and a rear wall 64 that cover an escrow space portion 35*a* in the deposited banknote escrow portion 35.

The deposited banknote escrow portion 35 is provided with feeding unit 66 that feeds, from the escrow transport path portion 43, deposited banknotes into the deposited banknote escrow portion 35 on a one-by-one basis and that feeds out, when the depositing operation is approved, the escrowed banknotes to the escrow transport path portion 43 on a one-by-one basis. The feeding unit 66 operates together with the collection board 65, which moves up and down with the banknotes thereon. The feeding unit 66 is provided with: a plurality of feed rollers 67 and gate rollers 68 arranged in an axial direction in which banknotes are fed from the escrow transport path portion 43 into the deposited banknote escrow portion 35 and in which banknotes are fed out from the deposited banknote escrow portion 35 to the escrow transport path portion 43; a kick roller 72 that feeds out, when banknotes are fed, the escrowed banknotes placed on the collection board 65 between the feed rollers 67 and the gate rollers 68 on a one-by-one basis.

In the lower unit 16, in the front side region of the main body 14, a removable box 81 that stores a gift certificate and the like is removably arranged, and a reject box 82 that stores rejected banknotes is fixedly arranged.

Figure 2:
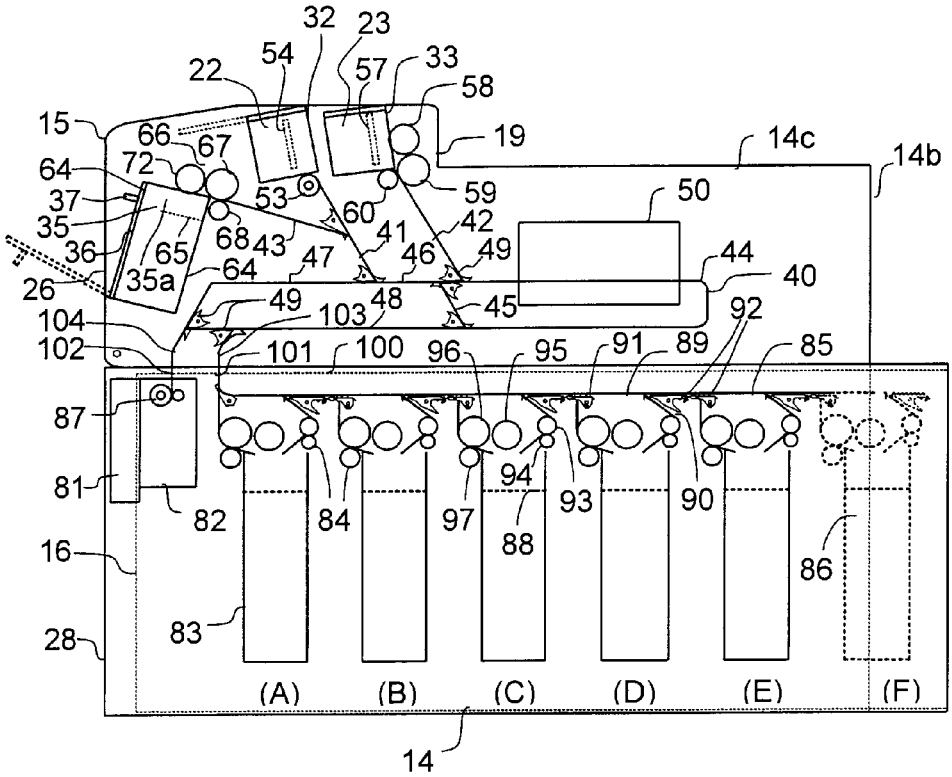
[FIG. 2] A cross-sectional view of the circulation type banknote depositing and dispensing machine according to the embodiment of the invention.

In a region behind the reject box 82, denomination-specific banknote storing portions 83 that store banknotes denomination by denomination are fixedly arranged in the forward and backward direction as represented by letters (A) to (E) in FIG. 2. Above the denomination-specific banknote storing portions 83, there are arranged banknote receiving and feeding portions 84 that receive and feed banknotes one by one. In a region above the denomination-specific banknote storing portions 83, there is arranged a lower unit banknote transport portion 85 that connects to the banknote receiving and feeding portions 84 to transport the banknotes. In a rearmost portion of the lower unit 16, as represented by the letter (F), there is formed an additional space 86 that allows a denomination-specific banknote storing portion 83 to be additionally provided as required.

In the reject box 82, there is arranged feed-in unit 87 that can feed in banknotes through an upper portion of the reject box 82 on a one-by-one basis.

In the denomination-specific banknote storing portions 83, a collection board 88 is provided such that it can move up and down; banknotes are stored on the collection board 88 with the sides of the banknotes pointing in the vertical direction.

The lower unit banknote transport portion 85 is provided with: a main transport path portion 89 that is arranged along the upper regions of the denomination-specific banknote storing portions 83 in the forward and backward direction; feed-in transport path portions 90 that transport banknotes fed from the main transport path portion 89 into the denomination-specific banknote storing portions 83; and feed-out transport path portions 91 that transport banknotes fed out of the denomination-specific banknote storing portions 83 to the main transport path portion 89. At the portions connected between the transport path portions 89 to 91, there are provided switching members 92 that switch a direction in which a banknote moves. The main transport path portion 89 in the lower unit banknote transport portion 85 can reverse the banknote transport direction, that is, can perform the transport in both forward and reverse directions.

The banknote receiving and feeding portion 84 operates together with the collection board 88, which moves up and down with the banknotes thereon. The banknote receiving and feeding portion 84 is provided with: feed-in rollers 93 and 94 that feed in, when banknotes are stored, banknotes from the feed-in transport path portions 90 onto the collection board 88; a kick roller 95 that feeds out, when banknotes are fed out, banknotes on the collection board 88 on a one-by-one basis; and a feed-out roller 96 and a gate roller 97 that feed out the banknote fed out by the kick roller 95 to the feed-out transport path portions 91.

When banknotes are fed into the denomination-specific banknote storing portion 83, since the height of the upper surface of a stack of banknotes is increased each time a banknote is placed on the collection board 88, the collection board 88 is sequentially lowered to receive the banknote such that the upper surface is kept within a predetermined range. When banknotes are fed out of the denomination-specific banknote storing portion 83, the collection board 88 is raised to press the banknote onto the kick roller 95, and the banknote is fed out by the rotation of the kick roller 95 one by one.

In the main body 14, a plate-shaped cover member 100 is fixed between the upper unit 15 and the lower unit 16 so as to cover the upper surface of the lower unit 16 housed in the main body 14 to block the lower unit 16. In the front end side of the cover member 100, there are formed a first opening portion 101 and a second opening portion 102. In the first opening portion 101, there is arranged a first connection passage portion 103 that connects the front end side of the storing/dispensing transport path portion 48 of the upper unit banknote transport portion 40 to the front end side of the lower unit banknote transport portion 85 and that transports banknotes; in the second opening portion 102, there is formed a second connection passage portion 104 that connects the rejected banknote transport path portion 47 of the upper unit banknote transport portion 40 to the reject box 82 and that transports banknotes.

With these first and second connection passage portions 103 and 104, it is possible to transport banknotes between the upper unit 15 and the lower unit 16 through the first opening portion 101 and the second opening portion 102 of the cover member 100 fixed to the main body 14 with the upper unit 15 and the lower unit 16 removable from the main body 14 being housed in the main body 14 and connected to each other. The first connection passage portion 103 and the second connection passage portion 104 can reverse the banknote transport direction, that is, can perform the transport in both forward and reverse directions.

Figure 3:
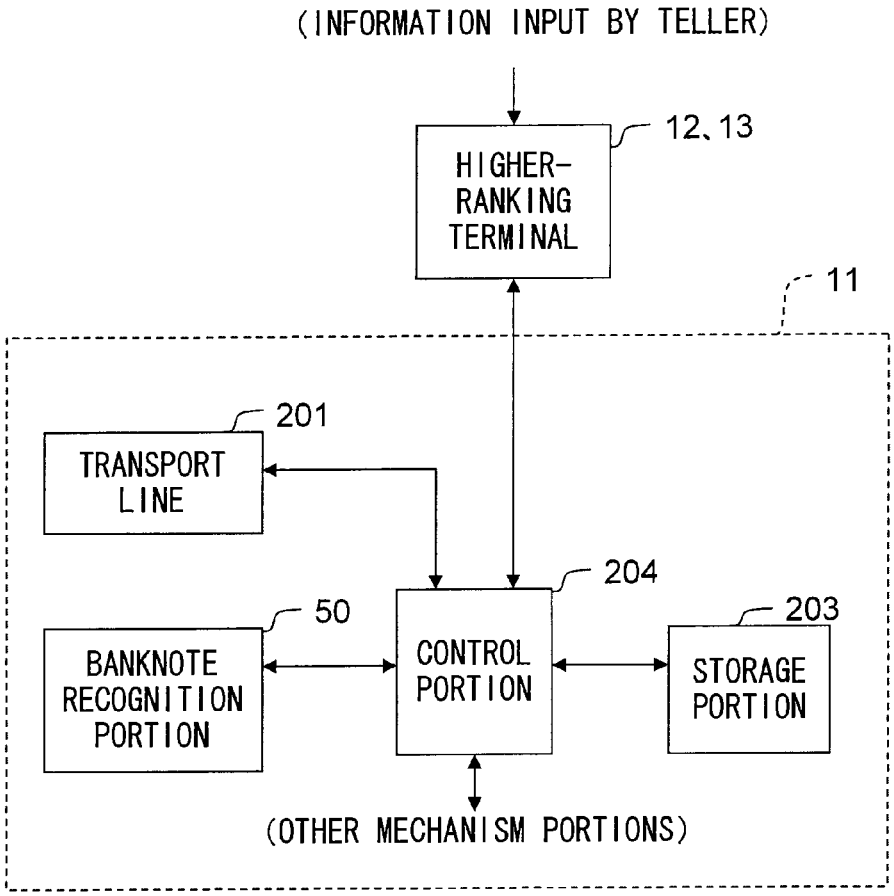
[FIG. 3] A diagram showing the control system of the circulation banknote depositing and dispensing machine and higher-ranking terminals.

The control system of a system composed of the banknote depositing and dispensing machine 11 and the higher-ranking terminals 12 and 13 will now be described with reference to FIG. 3. As shown in this figure, the banknote depositing and dispensing machine 11 includes not only what are described previously but also a transport line 201, a storage portion 203 and a control portion 204.

The transport line 201 refers to the entire line that are formed with, for example, the upper unit banknote transport portion 40 and the lower unit banknote transport portion 85 described previously and that transports banknotes. In particular, in the dispensing processing, the transport line 201 refers to one that transports banknotes from the denomination-specific banknote storing portions 83 to the banknote dispensing outlet 22 or the reject box 82.

In terms of function, the transport line 201 can be said to be a mechanism for producing a flow to sequentially move banknotes to the banknote dispensing outlet 22 or the reject box 82. Specifically, banknotes stored in each denomination-specific banknote storing portion 83 are fed out, by the banknote receiving and feeding portion 84 and the like, to the a predetermined position (a transport start position) on the transport line 201 corresponding to the denomination-specific banknote storing portion 83. In this way, the banknotes are put onto the flow of the transport line 201 and are transported to the banknote dispensing outlet 22 or the reject box 82.

The storage portion 203 is formed with a rewritable storage device such as a flash memory, and stores various types of information such as the amount of money corresponding to an instruction to dispense money and the number of banknotes of each denomination that are determined, by the banknote recognition portion 50, not to be allowed to be dispensed. The control portion 204 collectively controls the depositing processing, the dispensing processing and the like performed by the banknote depositing and dispensing machine 11. In controlling them, various types of information are used that are acquired from the higher-ranking terminals 12 and 13, the banknote recognition portion 50, the storage portion 203 and the like.

Figure 4:
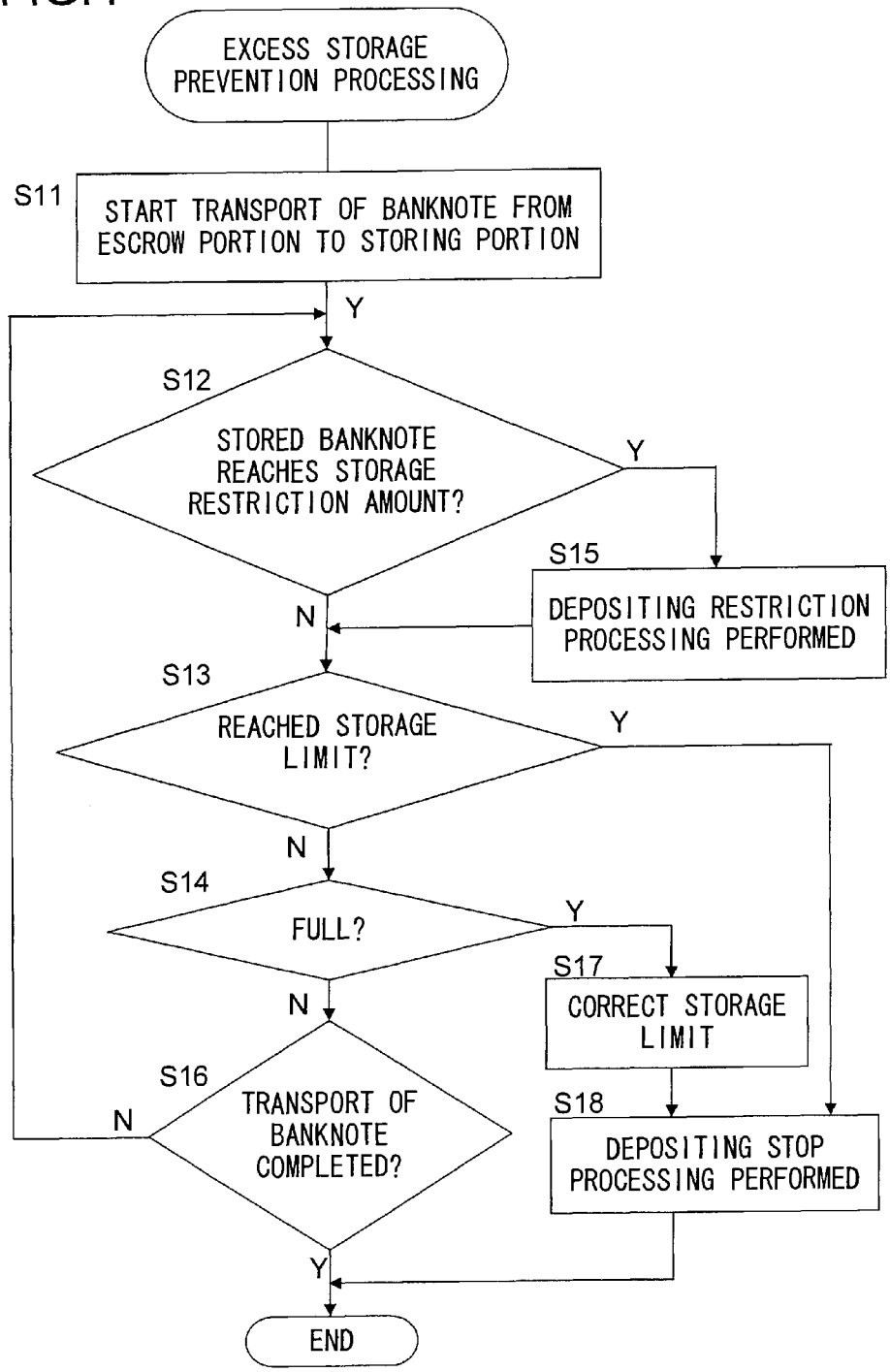
[FIG. 4] A flowchart of dispensing processing according to the embodiment of the invention.

With the banknote depositing and dispensing machine 11 configured as described above, it is possible to perform the banknote depositing processing (processing for storing received banknotes in predetermined locations), the dispensing processing (processing for taking the specified amount of money out of banknotes stored) and the like. The details of the dispensing processing performed by the banknote depositing and dispensing machine 11 will now be described with reference to the flowchart of FIG. 4.

When, for example, the teller on the left side uses the banknote depositing and dispensing machine 11, the occupation button 24 on the left side is operated, and thus the banknote depositing and dispensing machine 11 enters the occupation mode on the teller on the left side. In a counter of a financial institution, deposit information such as the amount of money corresponding to a customer's requirement for dispensing money is entered into the higher-ranking terminal 12 of the teller on the left side, and thus an operation for an instruction to dispense money is performed, with the result that the dispensing processing is started (Y in step S11). Here, information indicating how many banknotes of each denomination need to be transported (dispensed) is entered into the banknote depositing and dispensing machine 11.

The banknote depositing and dispensing machine 11 receives the instruction to dispense money to start the transport of the specified number of banknotes. Here, when banknotes of one denomination are dispensed, banknotes are sequentially fed out of only the denomination-specific banknote storing portion 83 of the corresponding denomination. On the other hand, when banknotes of a plurality of denominations are dispensed, likewise, in the transport line 201, the transport of banknotes from the denomination-specific banknote storing portion 83 in which the corresponding transport start position is farthest from the banknote dispensing outlet 22 (the transport path is longest) is first started (step S12).

Specifically, in the banknote depositing and dispensing machine 11, as the denomination-specific banknote storing portion 83 is located closer to the right side in FIG. 2, the corresponding transport start position is farther from the banknote dispensing outlet 22, and thus, the transport of banknotes is sequentially started from, among banknotes of denominations required to be dispensed, the transport of banknotes stored in the denomination-specific banknote storing portion 83 closest to the right side. The "starting the transport" specifically refers to the putting of banknotes onto the flow of the transport line 201 by the banknote receiving and feeding portion 84 and the like.

The banknote fed from the denomination-specific banknote storing portion 83 is transported through the first connection passage portion 103 from the feed-out transport path portion 91 and the main transport path portion 89 to the storing/dispensing transport path portion 48 and the recognition transport path portion 44 of the upper unit banknote transport portion 40. Then, whether or not the banknote is allowed to be dispensed is determined by the banknote recognition portion 50.

Whether or not the banknote is allowed to be dispensed is determined from predetermined criteria for the authenticity and the fitness of the banknote. The banknote that is determined to be allowed to be dispensed is fed from the recognition transport path portion 44 through the escrow dispensing transport path portion 46 and the dispensing transport path portion 41 into the banknote dispensing outlet 22, and is collected in an upright position. On the other hand, the banknote that is determined not to be allowed to be dispensed is fed from the recognition transport path portion 44 to the reject box 82 in the lower unit 16 through the escrow dispensing transport path portion 46, the rejected banknote transport path portion 47 and the second connection passage portion 104, with the result that the banknote is stored in the reject box 82. In this way, the processing (dispensing limitation processing) for preventing the completion of the transport of the banknote that is not allowed to be dispensed to the banknote dispensing outlet 22 is realized.

As described above, the transport of all the banknotes of a given denomination corresponding to the instruction to dispense money is started and then completed, and thereafter, from the denomination-specific banknote storing portion 83 in which its transport start position is second farthest from the banknote dispensing outlet 22, the transport of all the banknotes of the relevant denomination corresponding to the instruction to dispense money is sequentially started (step S14). Then, the transport of all the banknotes of each denomination included in the instruction to dispense money is started and then completed in this way (Y in step S13), and thereafter, if it is unnecessary to additionally transport money to replenish a shortage of dispensed money (N in step S15), the purpose of the dispensing processing is achieved, with the result that the dispensing processing is completed. Thereafter, the dispensed banknotes are taken from the banknote dispensing outlet 22 by the teller, and are handed over to a customer.

On the other hand, if it is necessary to additionally transport money to replenish the shortage of dispensed money (Y in step S15), then the banknote transport is additionally performed to replenish the shortage of dispensed money (step S16). Specifically, banknotes equivalent to banknotes stored in the reject box 82 are transported again from the denomination-specific banknote storing portions 83 to the banknote dispensing outlet 22. After the banknotes are transported again, if a shortage occurs, the banknote transport is repeated;

until all the banknotes corresponding to the instruction to dispense money reach the banknote dispensing outlet 22, the same processing is repeated.

Here, the shortage of dispensed money occurs because banknotes that are not to be allowed to be dispensed are transported to the reject box 82 and thus the number of the banknotes that reach the banknote dispensing outlet 22 is reduced by those banknotes. Thus, it is possible to identify both whether or not money needs to be additionally transported to replenish the shortage of dispensed money and the number of banknotes to be additionally transported by counting how many times a banknote is not allowed or otherwise on the processing for determining, by the banknote recognition portion 50, whether each banknote is allowed to be dispensed.

Figure 5:
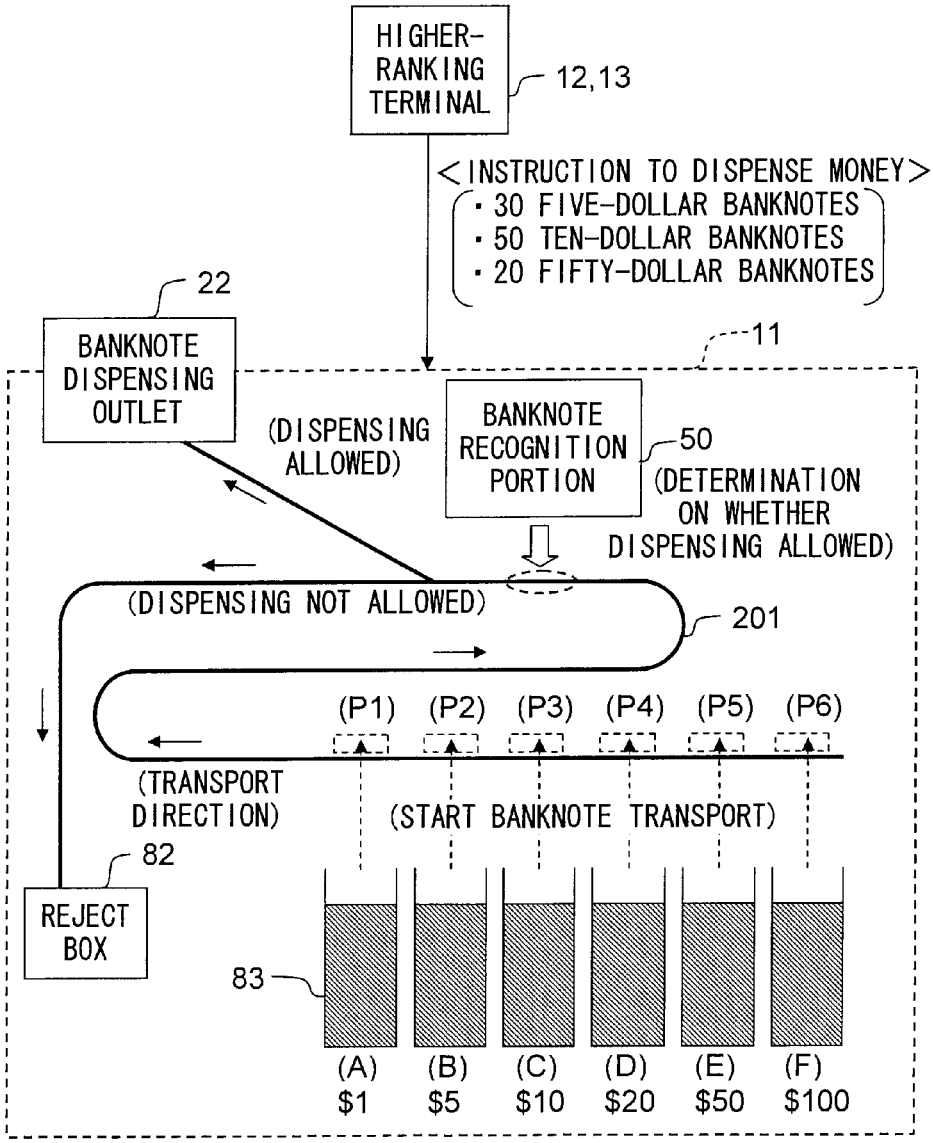
[FIG. 5] A diagram showing the dispensing processing according to the embodiment of the invention.

By performing the processing described above, money corresponding to an instruction to dispense money is successfully dispensed. Here, for ease of understanding the dispensing processing, a specific example of the dispensing processing will now be described below. In FIG. 5, the conditions of this example are schematically shown. Here, denominations assigned to the denomination-specific banknote storing portions 83 may be set in an order other than the following order, or may freely be set. In general, however, banknotes of small denomination are dispensed relatively often; since, in the processing for dispensing banknotes of a plurality of denominations, the dispensing of banknotes in order of decreasing denomination results in good balance of stacked banknotes in the banknote dispensing outlet 22, the denominations are assigned as follows.

In this example, as shown in FIG. 5, the denomination-specific banknote storing portions 83 are set to store one-dollar banknotes, five-dollar banknotes, ten-dollar banknotes, twenty-dollar banknotes, fifty-dollar banknotes and one-hundred-dollar banknotes in this order from the denomination-specific banknote storing portion 83 closest to the banknote dispensing outlet 22; banknotes are sufficiently assumed to be stored in the denomination-specific banknote storing portions 83. The banknotes of each denomination are fed out, by the banknote receiving and feeding portions 84 and the like, to the transport start position (positions represented by P1 to P6 in FIG. 5) corresponding to each of the denomination-specific banknote storing portions 83, with the result that the transport is started.

Here, it is assumed that only one banknote which is not allowed to be dispensed is mixed into the ten-dollar banknote denomination-specific banknote storing portion 83, and that an instruction to dispense 30 five-dollar banknotes, 50 ten-dollar banknotes and 20 fifty-dollar banknotes is received from the higher-ranking terminal (step S11). In this case, the denominations of the five-dollar banknote, the ten-dollar banknote and the fifty-dollar banknote are denominations necessary for the dispensing of money.

The banknote depositing and dispensing machine 11 receives the instruction to dispense money to feed out and put banknotes onto the transport line one by one from the fifty-dollar denomination-specific banknote storing portion 83 in which the corresponding transport start position is farthest from the banknote dispensing outlet 22, with the result that the transport of banknotes is started (step S12). Thereafter, the transport of 20 fifty-dollar banknotes is started and then completed, and, likewise, the transport of banknotes is started on the ten-dollar denomination-specific banknote storing portion 83 in which the corresponding transport start position is second farthest from the banknote dispensing outlet 22 (step S14).

Here, immediately when the 20th fifty-dollar banknote passes through the transport start position (P3 in FIG. 3) of the ten-dollar banknote denomination-specific banknote storing portion 83, the transport of the first ten-dollar banknote is started. In this way, in the transport line 201, an interval between the last fifty-dollar banknote and the first ten-dollar banknote is prevented from being significantly increased, with the result that the blank period of the transport is minimized.

To prevent an interval between the last banknote of a given denomination and the first banknote of the succeeding denomination from being significantly increased is facilitated by sequentially performing, as in this embodiment, the transport of banknotes from the denomination-specific banknote storing portion 83 in which the corresponding transport start position is farthest from the banknote dispensing outlet 22. If the transport of fifty-dollar banknotes is performed after the transport of ten-dollar banknotes, in order for the interval to be reduced, it is necessary to, for example, start the transport of the first fifty-dollar banknote before the start of the transport of the last ten-dollar banknote. In this case, it is more likely that, for example, the ten-dollar banknote overlaps the fifty-dollar banknote, with the result that a transport trouble is more likely to occur.

Then, when the transport of the fiftieth ten-dollar banknote is started, the transport of 30 five-dollar banknotes on a one-by-one basis is likewise started. If, during the transport of the ten-dollar banknotes, the banknote recognition portion 50 determines the banknote not to be allowed to be dispensed, the banknote is transported to the reject box; however, in this point, a banknote for compensating for the banknote determined not to be allowed to be dispensed is not additionally transported.

When the transport of the thirtieth five-dollar banknote is started, this means that the transport of all the banknotes corresponding to the instruction to dispense money has been started (Y in step S13). Thereafter, since the shortage of dispensed money is one ten-dollar banknote (Y in step S15), the additional transport of one ten-dollar banknote is started (step S16). Then, this one ten-dollar banknote is determined to be allowed to be dispensed, and then reaches the banknote dispensing outlet 22, with the result that the dispensing processing is completed.

By performing the dispensing processing (hereinafter, referred to as "first processing") described above and according to this embodiment, it is possible to reduce processing period as compared with dispensing processing (hereinafter, referred to as "second processing") in which, for example, when, during the transport of money of a certain denomination to be dispensed, money is determined not to be allowed to be dispensed, money is additionally transported to replenish such a shortage and then the transport of money of another denomination is started. In order for this reason to be explained, the case where dispensing processing equivalent to that of the example described previously is assumed to be performed in the second processing will be described below.

For example, the transport of 20 fifty-dollar banknotes on a one-by-one basis is first started. Since the fifty-dollar banknotes are allowed to be dispensed, the transport of 50 ten-dollar banknotes is then started, and specifically, this starting is done after the 20th fifty-dollar banknote reaches the banknote recognition portion 50 and is determined to be allowed to be dispensed. That is because, even if the first to the ninetieth fifty-dollar banknotes are determined to be allowed to be dispensed, until the 20th banknote, which is the last one, is determined to be allowed to be dispensed, it is unclear whether the additional transport of a fifty-dollar banknote needs to be performed or the process proceeds to the transport of ten-dollar banknotes of the subsequent denomination.

Then, when the process proceeds to the transport of ten-dollar banknotes, banknotes are transported one by one such that 50 banknotes of this denomination reach the banknote dispensing outlet 22. Here, in the transport of the ten-dollar banknotes, one banknote is not allowed to be dispensed, and consequently, the transport of 51 banknotes is started. Thereafter, likewise, the transport of the five-dollar banknotes is performed, with the result that the dispensing processing is completed.

As described above, in the second processing, until the number of banknotes of a certain denomination that are allowed to be dispensed is determined to be equal to the number of banknotes corresponding to an instruction to dispense money, the transport of banknotes of the succeeding denomination is not started. A determination as to whether or not a banknote is allowed to be dispensed is not made until the banknote reaches the banknote recognition portion 50 positioned halfway (downstream from the transport start point) on the transport line. Hence, in a stage where the transport of banknotes of the current denomination is transferred to the transport of banknotes of the succeeding denomination, during the period during which the last banknote of the current denomination is transported from the transport start position to the banknote recognition portion 50, no banknote is naturally transported (there is a blank period of the transport.) When the blank period occurs, the transport of banknotes is stopped for the blank period, with the result that the dispensing processing delays.

On the other hand, in the first processing, based on the instruction to dispense money, the denomination and the number of banknotes that need to be started to be transported are previously found out (the transport of banknotes that replenish a shortage is performed after the transport of all the banknotes corresponding to the instruction to dispense money is completed.) Hence, as described above, after the start of the transport of the last banknote of a certain denomination, without the need to wait for a determination as to whether or not this banknote is allowed to be dispensed, it is possible to start the transport of banknotes of the succeeding denomination.

As described above, with the dispensing processing of this embodiment, it is possible to quickly dispense money as compared with the conventional processing. In particular, when money is rarely determined not to be allowed to be dispensed (for example, when almost all money is determined to be allowed to be dispensed), with the dispensing processing of this embodiment, it is possible not only to very quickly perform the processing as compared to the conventional processing but also to perform proper handling if a banknote that is determined not to be allowed to be dispensed is detected.

That is, the second processing is performed such that the process proceeds from "the transport of banknotes of the first denomination (including the additional transport to replenish a shortage)" to "a blank period of the transport" to "the transport of banknotes of the second denomination (including the additional transport to replenish a shortage)" to "a blank period of the transport" . . . to "a blank period of the transport" and to "the transport of banknotes of the last denomination (including the additional transport to replenish a shortage)", whereas the first processing is performed such that the process proceeds from "the transport of banknotes of the first denomination" to "the transport of banknotes of the second denomination" . . . to "the transport of banknotes of the last denomination" and to "the additional transport to replenish a shortage (which is omitted if there is no shortage)." Thus, it is possible to perform the dispensing processing more quickly and successfully because "blank periods of the transport" are reduced.

Although the banknote depositing and dispensing machine 11 of the present invention performs, as the dispensing processing, the first processing described above, the first processing and the second processing may be selectably performed. In this case, for example, the tellers operate the higher-ranking terminals 12 and 13, and, according to these operations, the higher-ranking terminals 12 and 13 preferably output, to the banknote depositing and dispensing machine 11, information indicating which one of the first processing and the second processing needs to be performed. In this way, it is possible for the teller (user) to freely select which one of the first processing and the second processing is performed. Thus, it is possible to change the flow of the dispensing processing according to the situation, with the result that a more versatile banknote depositing and dispensing machine is provided.

The banknote dispensing portion 32 may have a mechanism of collecting banknotes transported from the denomination-specific banknote storing portions 83 on a denomination-by-denomination basis. An example of this mechanism will be described below with reference to FIG. 6.

Figure 6:
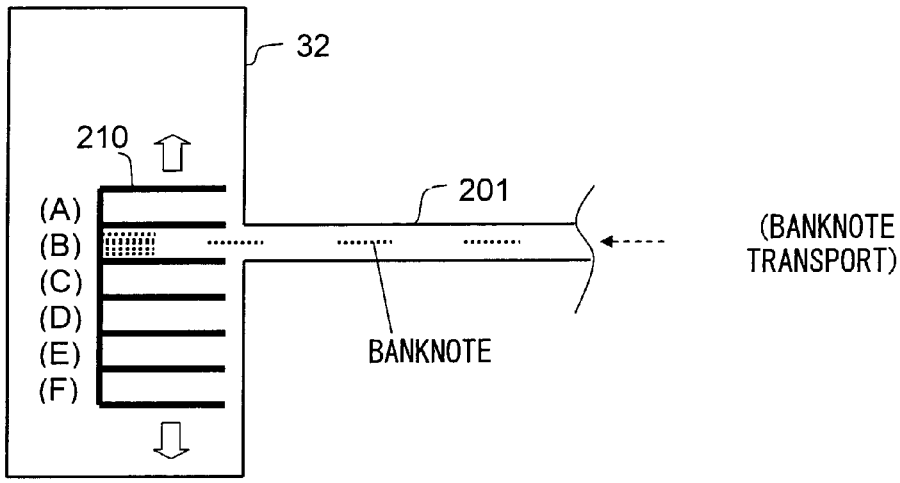
[FIG. 6] A diagram showing a mechanism of collecting dispensed banknotes on a denomination-by-denomination basis.

As shown in FIG. 6, the banknote dispensing portion 32 is provided with a movable banknote storing unit 210. This movable banknote storing unit 210 has banknote storage spaces corresponding to the denomination-specific banknote storing portions 83, and the individual storage spaces are partitioned. The movable banknote storing unit 210 can move in a direction indicated by the arrows of FIG. 6 according to an instruction from the control portion 204, and thus it is possible to change the storage space to the storage space (to which the banknote is transported) corresponding to the transport line 201. In the conditions shown in FIG. 6, the storage space represented by the letter (B) corresponds to the movable banknote storing unit 210.

In this mechanism, since, at the time of the dispensing of banknotes of a plurality of denominations, the movable banknote storing unit 210 is appropriately moved according to the denomination of a banknote that reaches the banknote dispensing portion 32, it is possible to collect dispensed banknotes denomination by denomination. This allows the teller to eliminate the operation of dividing dispensed banknotes on a denomination-by-denomination basis, with the result that it is possible to reduce work and time on a depositing transaction.

Example 2

Example 2 will now be described. In the above-described banknote depositing and dispensing machine (money handling machine), a limit capacity is previously determined for each of the denomination-specific banknote storing portions 83 such that banknotes are prevented from being stored beyond the limit capacity. One specific way to realize it is to stop all the depositing processing when the denomination-specific banknote storing portion 83 of a certain denomination reaches the limit capacity.

In this way, although, when banknotes of a denomination other than the denomination corresponding to the denomination-specific banknote storing portion 83 that reaches the limit capacity are deposited, the banknotes of this denomination can be substantially deposited (in terms of the capacity of the storing portion), until the banknotes stored in the denomination-specific banknote storing portion 83 that reaches the limit capacity are collected halfway (the banknotes are taken out of the storing portion manually or otherwise), it is disadvantageously impossible to perform the depositing processing. This is undesirable because it may result in the depositing operation being often stopped.

Thus, when the fact that the denomination-specific banknote storing portion 83 of a certain denomination reaches the limit capacity is detected, software processing may be carried out that prevents depositing processing for only such a denomination from being further performed. For example, among banknotes that are put into the banknote depositing inlet 23 in the depositing processing, the banknotes of a denomination corresponding to the denomination-specific banknote storing portion 83 that reaches the limit capacity are transported to the banknote dispensing outlet 22 whereas the banknotes of other denominations are transported either to the other denomination-specific banknote storing portions 83 or to the deposited banknote escrow portion 35.

In this way, it is possible to deposit money until the storing portions of all the denominations reach the limit capacity. The banknotes that are transported to the banknote dispensing outlet 22 because the corresponding storing portion reaches the limit capacity are manually counted by the teller and organized in another location, and thus it is possible to perform operations as usual.

Example 3

Example 3 will now be described. The denomination-specific banknote storing portions 83 and the deposited banknote escrow portion 35 described above are provided with a mechanism (feed-out mechanism) for feeding out banknotes stored temporarily. Here, the operation of a conventional feed-out mechanism will be specifically described below.

In this feed-out mechanism, feed-out rollers (a feed roller and a kick roller connected thereto) are rotated one revolution, and thus one banknote is fed out. Banknotes are randomly stored on top of each other in a storage space slightly larger than the size of the plane of the banknote. In particular, a device that handles banknotes in which there is a difference between dimensions in their short edge direction may need to be operated with a storage space for banknotes larger than that of a conventional device so that a unit is standardized.

The first banknote is moved a distance (referred to as a "space movement distance") composed of a play dimension of the storage space and a dimension from the end surface of the storage space to the holding point of a separation roller, and reaches the separation roller. Since the "nth" and subsequent banknotes are substantially pulled up to the separation roller due to friction with "(n−1)th" banknote, the space movement distance is significantly reduced. The rubber portion of the kick roller is previously placed on the side (rear side) opposite the banknote storage plane so that the rubber portion can make contact with the banknote over the entire effective kick rubber length, starting with the first banknote.

Since the first banknote moves, by the space movement distance, more than the movement amount of any one of the second and subsequent banknotes, and thus the space between the first banknote and the second banknote is narrow, they are more likely to be fed out simultaneously. Hence, after the first banknote is detected to be fed out, a feed-out motor is stopped for a predetermined period, and thus the space between the first banknote and the second banknote is increased. The flow of the operations of conventional feed-out mechanism described above is shown in FIG. 7.

Figure 7:
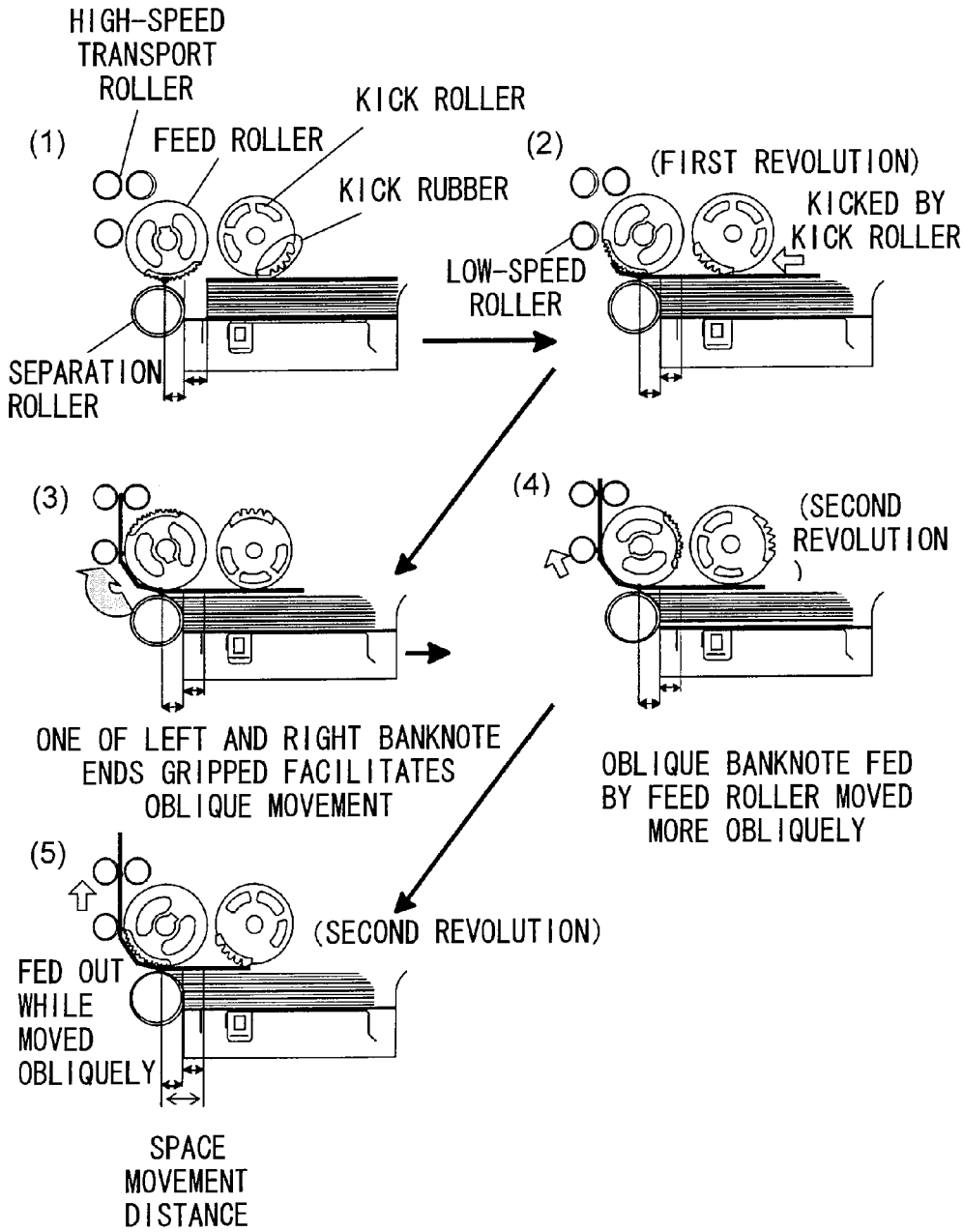
[FIG. 7] A diagram showing an example of a conventional banknote feed-out mechanism.

In FIG. 7(3), in order to control the space between the first banknote and the second banknote, the feed-out motor is slowed down and is then stopped. When the feed-out motor is slowed down, one end of the banknote is often gripped at the holding point of a high-speed transport roller, and the banknote pivots about the holding point of the separation roller, with the result that the banknote may obliquely move. In FIG. 7(4), even when the kick rubber does not function, a low-speed roller arranged adjacent to the feed roller grips the banknote and feeds it in the direction of movement. This facilitates the oblique movement of the banknote.

In this feed-out mechanism, although the first banknote and the nth banknote are moved forward with the same kick rubber, the first banknote is fed, by the space movement distance, relatively less than a feeding distance, with the result that the first banknote cannot be completely fed out during the first revolution of the feed-out roller and that it may be fed out during the second revolution of the feed-out roller.

When the banknote is not completely fed out during one revolution as described above, one portion of the banknote kept stationary around the separation roller is held by the high-speed roller, and thus the one portion, which is held, is pulled out, and the other portion, which is not held, is kept stationary by the separation roller. For this reason, the banknote moves very obliquely, and thus is fed out in an oblique state during the second revolution.

This problem is because, when the first banknote is fed out, the banknote moves the space movement distance up to the separation roller. In order for the first banknote to accurately move only the space movement distance during the first revolution, the position of the first banknote is preferably controlled by utilizing part of the effective kick rubber length. The flow of the operations of such a feed-out mechanism is shown in FIG. 8.

Figure 8:
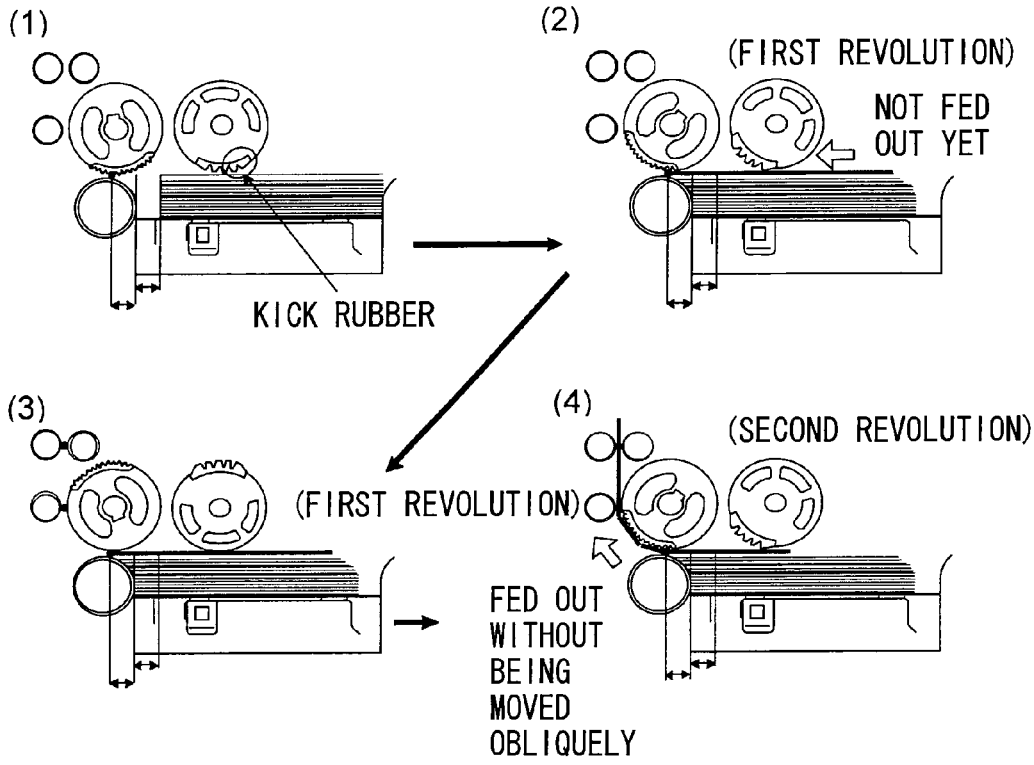
[FIG. 8] A diagram showing a banknote feed-out mechanism according to the embodiment of the invention.

In FIG. 8(2), since the effective kick rubber length of the kick roller is half the entire rubber, the first banknote is fed by the kick roller but stops at the holding point of the separation roller. In FIG. 8(3), the banknote does not reach the holding point of the low-speed roller, and thus remains stationary.

As described above, the first banknote is accurately moved only the space movement distance during the first revolution of the feed-out roller, and thus the position of the banknote is controlled such that the first banknote and the second banknote are in the same state, with the result that banknotes are stably fed out. Hence, the frequency at which the banknote moves very obliquely at a feed-out portion is reduced, and thus it is possible to reduce the frequency at which processing is stopped due to the occurrence of a banknote jam. Moreover, since the first banknote is stably fed out, the slightly oblique movement of a banknote is expected to be reduced, and thus it is possible to effectively utilize banknotes within the device because the rate at which the banknote successfully passes is improved.

The feed-out mechanism described above can be generally applied not only to a banknote depositing and dispensing machine but also to a mechanism for feeding out paper sheets (such as a banknote, a certificate, a ballot paper and a card) stored in a storing unit. When, in a printer or the like, printing is performed in parallel to paper, the positions of the ends of the paper are aligned by utilizing part of the effective kick rubber length, and the alignment of the ends is performed in this way; this makes it easier to correct the oblique movement. Thus, it is expected that the accuracy of printing is enhanced.

Industrial Applicability

The present invention can be utilized in a money handling machine or the like used in a financial institution.

The invention claimed is:

1. A money handling machine for handling money comprising:

a denomination-specific storing portion that has a plurality of storing units and that stores money by denomination in the storing units;

a money transport unit that transports money to a predetermined dispending portion;

a transport starting unit that causes the money transport unit to start transport of the money stored in the denomination-specific storing portion; and a dispensing limitation portion that performs dispensing limitation processing on the money being transported, wherein at least dispensing processing is performed in which, an amount of money to be dispensed out of the money stored in the denomination-specific storing portion is brought to the dispending portion through the transport;

the dispensing limitation processing is processing in which whether or not the money is allowed to be dispensed is determined based on predetermined conditions, and in which the transport of money determined not to be allowed to be dispensed is prevented from being completed such that the money is not dispensed; and the dispensing processing includes a first step of causing the transport starting unit to start the transport of the amount of money to be dispensed and a second step of transporting, after completion of the first step for all denominations to be dispensed, money from the denomination-specific storing portion to the dispensing portion such that a shortage of dispensed money produced by performing the dispensing limitation processing is replenished.

2. The money handling machine of claim 1, wherein the money transport unit includes a transport line that produces a flow for transferring the money to the dispensing portion, and the transport starting unit starts the transport by putting the money on the flow of the transport line.

3. The money handling machine of claim 2, wherein the transport starting unit transfers the money stored in the denomination-specific storing portion to a transport start position, on the transport line, that is predetermined for each of the storing units so as to put the money on the flow of the transport line; and, when money of a plurality of denominations is transported to the dispensing portion, the dispensing processing starts the transport from money stored in one of the storing units where a distance on the transport line between the dispensing portion and the transport start position is greatest, in decreasing order of the distance.

4. The money handling machine of claim 1, wherein, when the dispensing processing is performed on money of a plurality of denominations, any of first processing and second processing can be selected and performed as the dispensing processing, and the first processing includes: the first step; and the second step, whereas the second processing includes: a third step of transporting, with the money transport unit, money of a given denomination out of the amount of money to be dispensed; a fourth step of transporting, when a shortage of dispensed money of the denomination is produced by performing the dispensing limitation processing, the money of the denomination until the shortage is replenished; and a fifth step of performing the third step and the fourth step on money of each of the plurality of denominations in a sequential manner.

5. The money handling machine of claim 4, wherein a user can select which one of the first processing and the second processing is performed.

6. The money handling machine of claim 4, further comprising:

a communication interface which enables communication with an external device, wherein which one of the first processing and the second processing is selected based on information transmitted from the external device.

7. The money handling machine of claim 1, wherein the dispensing portion has a mechanism of collecting the money transported from the denomination-specific storing portion on a denomination-by-denomination basis.

8. A money handling machine for handling money comprising:

a denomination-specific storing portion that has a plurality of storing units and that stores money by denomination in the storing units;

a money transport unit that transports money to a predetermined dispending portion;

a transport starting unit that causes the money transport unit to start transport of the money stored in the denomination-specific storing portion; and a dispensing limitation portion that performs dispensing limitation processing on the money being transported, wherein at least dispensing processing is performed in which, an amount of money to be dispensed out of the money stored in the denomination-specific storing portion is brought to the dispending portion through the transport;

the dispensing limitation processing is processing in which whether or not the money is allowed to be dispensed is determined based on predetermined conditions, and in which the transport of money determined not to be allowed to be dispensed is prevented from being completed such that the money is not dispensed; and the dispensing processing is processing in which, after the transport of the amount of money to be dispensed is started for all denominations to be dispensed, money is transported from the denomination-specific storing portion to the dispensing portion such that a shortage of dispensed money produced by performing the dispensing limitation processing is replenished.

9. The money handling machine of claim 8, wherein the money transport unit includes a transport line that produces a flow for transferring the money to the dispensing portion, and the transport starting unit starts the transport by putting the money on the flow of the transport line.

10. The money handling machine of claim 9, wherein the transport starting unit transfers the money stored in the denomination-specific storing portion to a transport start position, on the transport line, that is predetermined for each of the storing units so as to put the money on the flow of the transport line; and, when money of a plurality of denominations is transported to the dispensing portion, the dispensing processing starts the transport from money stored in one of the storing units where a distance on the transport line between the dispensing portion and the transport start position is greatest, in decreasing order of the distance.

11. The money handling machine of claim 8, wherein the dispensing portion has a mechanism of collecting the money transported from the denomination-specific storing portion on a denomination-by-denomination basis.

12. A method of controlling a money handling machine including a denomination-specific storing portion that has a plurality of storing units and that stores money by denomination in the storing portions such that the money handling machine performs dispensing processing in which an amount of money to be dispensed out of the money stored in the denomination-specific storing portion is transported to a predetermined dispensing portion, the method comprising:

a first step of starting the transport of the amount of all money to be dispensed out of the money stored in the denomination-specific storing portion to the dispensing portion;

a second step of determining, on the money being transported in the first step, whether or not the money is allowed to be dispensed, and of performing, on money determined not to be allowed to be dispensed, the dispensing limitation processing for preventing the transport from being completed; and a third step of transporting, after completion of the first step for all denominations to be dispensed, money from the denomination-specific storing portion to the dispensing portion such that a shortage of dispensed money produced by performing the dispensing limitation processing is replenished.

* * * * *